US005895085A

United States Patent [19]

Miller, Jr.

[11] Patent Number: 5,895,085

[45] Date of Patent: Apr. 20, 1999

[54] HELMET CARRYING AND HANGER ASSEMBLY

[76] Inventor: Thomas L. Miller, Jr., 74190 Desert Star Blvd., Palm Desert, Calif. 92260

[21] Appl. No.: 08/912,376

[22] Filed: Aug. 18, 1997

[51] Int. Cl.[6] ..... A47F 7/00

[52] U.S. Cl. ..... 294/143; 211/85.7; 211/87.01; 294/159

[58] Field of Search ..... 294/5.5, 15, 26, 294/87.28, 141–143, 146, 158–160, 169, 170; 206/315.1, 315.9; 211/13.1, 59.1, 60.1, 85.7, 87.01, 123, 124; 224/584, 919; D6/552

[56] References Cited

U.S. PATENT DOCUMENTS

| | | | |
|---|---|---|---|
| 378,727 | 2/1888 | Sculthorp | 294/5.5 |
| 885,580 | 4/1908 | Breckenridge | 294/15 |
| 2,616,751 | 11/1952 | Goldenberg | 294/87.28 |
| 2,625,422 | 1/1953 | Roberts et al. | 294/15 |
| 4,193,495 | 3/1980 | Keeley | 294/143 |
| 4,826,231 | 5/1989 | Bakhit | 294/158 |
| 5,294,005 | 3/1994 | Hedges | 211/87.01 X |

FOREIGN PATENT DOCUMENTS

| | | | |
|---|---|---|---|
| 399445 | 10/1933 | United Kingdom | 294/159 |

*Primary Examiner*—Johnny D. Cherry

[57] ABSTRACT

A helmet carrying and hanger assembly is provided including an elongated rod having a pair of ends. A plurality of helmet coupling mechanisms are provided for mounting the helmets to the elongated rod. A handle is coupled to the rod for carrying purposes. Finally, a mounting assembly is included for mounting the elongated rod to a fence.

1 Claim, 2 Drawing Sheets

HELMET CARRYING AND HANGER ASSEMBLY

BACKGROUND OF THE INVENTION

1. Field of the Invention

The present invention relates to a helmet carrying and hanger assembly and more particularly pertains to maintaining a plurality of helmets in an easily carried and organized orientation.

2. Description of the Prior Art

The use of helmet hangers is known in the prior art. More specifically, helmet hangers heretofore devised and utilized for the purpose of organizing helmets are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,193,495; U.S. Pat. No. 5,294,005; U.S. Pat. No. Des. 357,777; U.S. Pat. No. 4,629,065; and U.S. Pat. No. 4,793,532.

In this respect, the helmet carrying and hanger assembly according to the present invention substantially departs from the conventional concepts and designs of the prior art, and in so doing provides an apparatus primarily developed for the purpose of maintaining a plurality of helmets in an easily carried and organized orientation.

Therefore, it can be appreciated that there exists a continuing need for a new and improved helmet carrying and hanger assembly which can be used for maintaining a plurality of helmets in an easily carried and organized orientation. In this regard, the present invention substantially fulfills this need.

SUMMARY OF THE INVENTION

In view of the foregoing disadvantages inherent in the known types of helmet hangers now present in the prior art, the present invention provides an improved helmet carrying and hanger assembly. As such, the general purpose of the present invention, which will be described subsequently in greater detail, is to provide a new and improved helmet carrying and hanger assembly which has all the advantages of the prior art and none of the disadvantages.

To attain this, the present invention essentially comprises a plurality of helmets each with at least one ear covering integrally coupled thereto with a circular aperture formed therein. The present invention is further adapted for use with a vertically oriented chain-link fence having a matrix of zigzagging wires intermeshed to define a plurality of gaps. As shown in FIG. 1, an elongated linear tubular rod is provided having a pair of ends. A plurality of short linear tubular hangers is included. Each of the hangers has a first end coupled in perpendicular relationship along a length of the rod and a free second. A length of each rod is ideally equal to a width of the helmet. This is especially critical when used with helmets with two ear coverings as will become apparent. The hangers are further equally spaced and reside in a common first plane. Next provided is a T-shaped handle having a first extent in the first plane and with a length equal to that of the hangers. The first extent is coupled to a central extent of the rod. Associated therewith is a second extent integrally coupled at a center thereof in perpendicular relationship with the first extent of the handle for providing a grip for carrying purposes. Finally, a mounting assembly is provided including a pair of L-shaped members. Each L-shaped member has a short linear portion integrally coupled at a first end thereof to a corresponding end of the rod and extending in a direction opposite that of the hangers. Note FIGS. 1 & 2. The L-shaped members of the mounting assembly further include a long linear portion having a first end coupled to a second end of the corresponding short linear portion and extending in a direction perpendicular in relation with the hangers. It should be noted that the L-shaped members each reside in a plane perpendicular with respect to the first plane.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved helmet carrying and hanger assembly which has all the advantages of the prior art helmet hangers and none of the disadvantages.

It is another object of the present invention to provide a new and improved helmet carrying and hanger assembly which may be easily and efficiently manufactured and marketed.

It is a further object of the present invention to provide a new and improved helmet carrying and hanger assembly which is of a durable and reliable construction.

An even further object of the present invention is to provide a new and improved helmet carrying and hanger assembly which is susceptible of a low cost of manufacture with regard to both materials and labor, and which accordingly is then susceptible of low prices of sale to the consuming public, thereby making such helmet carrying and hanger assembly economically available to the buying public.

Still yet another object of the present invention is to provide a new and improved helmet carrying and hanger assembly which provides in the apparatuses and methods of the prior art some of the advantages thereof, while simultaneously overcoming some of the disadvantages normally associated therewith.

Still another object of the present invention is to maintain a plurality of helmets in an easily carried and organized orientation.

Lastly, it is an object of the present invention to provide a new and improved helmet carrying and hanger assembly including an elongated rod having a pair of ends. A plurality of helmet coupling mechanisms are provided for mounting the helmets to the elongated rod. A handle is coupled to the rod for carrying purposes. Finally, a mounting assembly is included for mounting the elongated rod to the fence.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
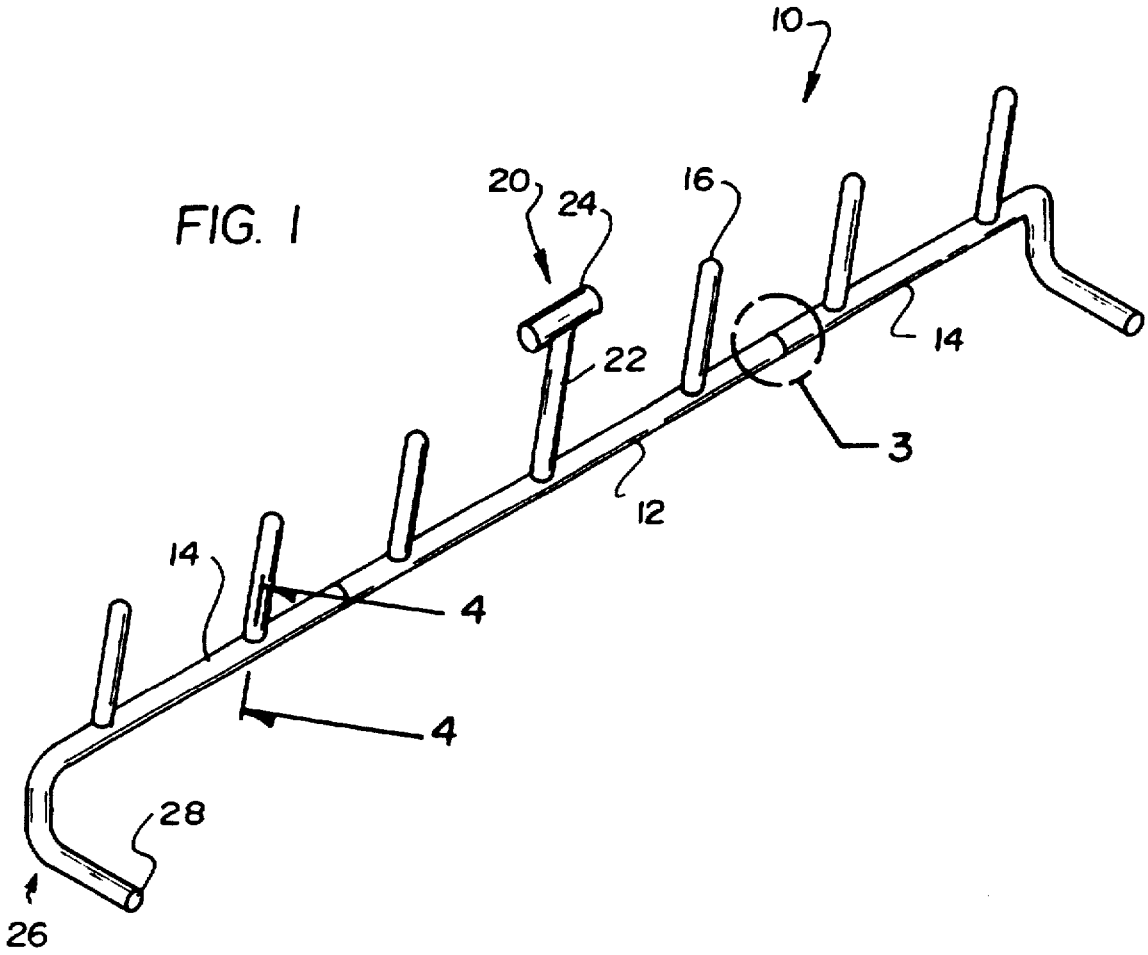
FIG. 1 is a perspective illustration of the preferred embodiment of the helmet carrying and hanger assembly constructed in accordance with the principles of the present invention.

With reference now to the drawings, and in particular to FIG. 1 thereof, a new and improved helmet carrying and hanger assembly embodying the principles and concepts of the present invention and generally designated by the reference numeral 10 will be described.

The present invention, the new and improved helmet carrying and hanger assembly, is comprised of a plurality of components. Such components in their broadest context include an elongated rod, a plurality of hangers, a mounting assembly and a handle wherein such components are individually configured and correlated with respect to each other so as to attain the desired objective.

More specifically, it will be noted that the system 10 of the present invention is adapted for use with a plurality of helmets each with at least one ear covering integrally coupled thereto with a circular aperture formed therein. The present invention is further adapted for use with a vertically oriented chain-link fence having a matrix of zig-zagging wires intermeshed to define a plurality of gaps.

Figure 3:
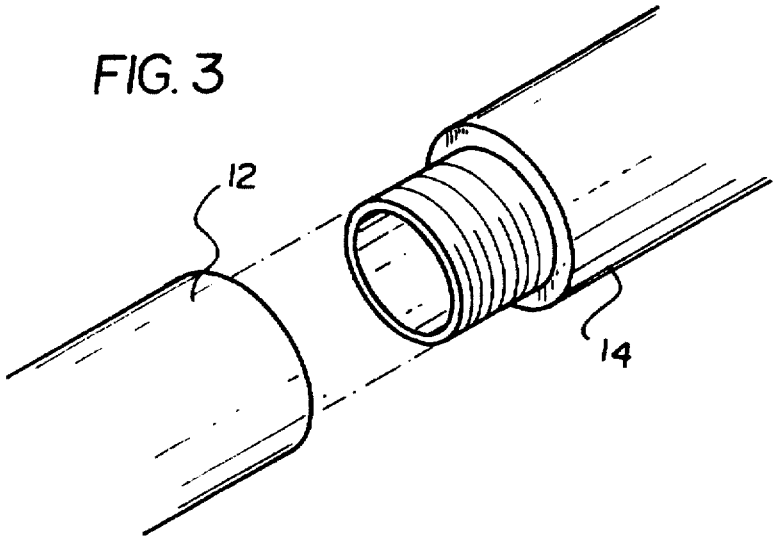
FIG. 3 is a perspective view of the screwable coupling between the various components of rod of the present invention.
Figure 4:
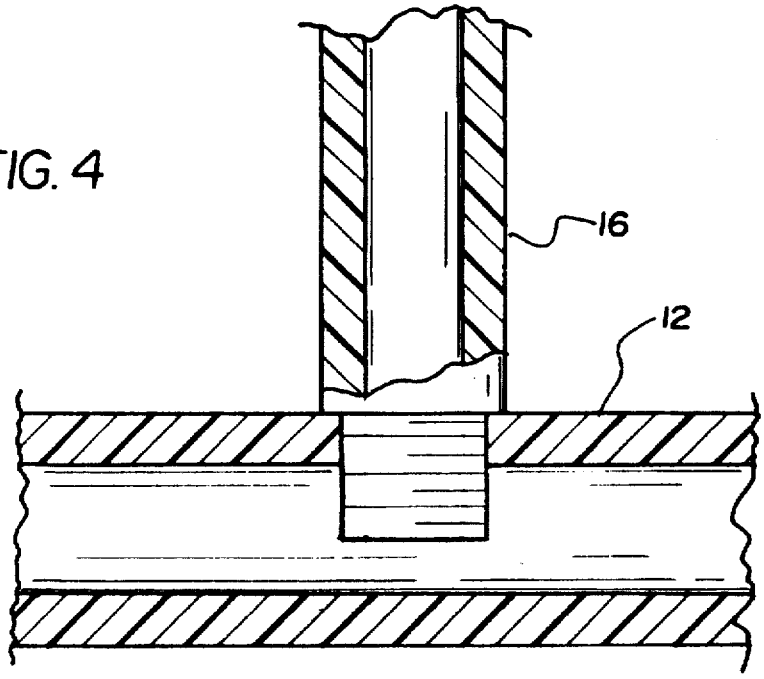
FIG. 4 is a cross-sectional view of the screwable coupling between the hangers and rod of the present invention.

As shown in FIG. 1, an elongated linear tubular rod 12 is provided having a pair of ends. In the preferred embodiment, the rod is subdivided in a plurality of subsection 14 of equal length which are interconnected in linear alignment by way of a screwable coupling, as shown in FIG. 3. The full length of the rod is preferably about 55 inches. A plurality of short linear tubular hangers 16 is included. Each of the hangers has a first end coupled in perpendicular relationship along a length of the rod and a free second. A length of each rod is ideally equal to a width of the helmet. This is especially critical when the present invention is used with helmets with two ear coverings as will become apparent. The hangers are further equally spaced and reside in a common first plane.

It should be noted that a screwable coupling is employed to secure the hangers with the elongated rod. This structure in combination with releasable coupling of the subsections of the rod allow the present invention to be sized to accommodate various quantities of helmets.

Next provided is a T-shaped handle 20 having a first extent 22 in the first plane and with a length equal to that of the hangers. The first extent is coupled to a central extent of a central component of the rod. Associated therewith is a second extent 24 integrally coupled at a center thereof in perpendicular relationship with the first extent of the handle for providing a grip for carrying purposes. As shown in FIG. 1, the second extent 24 remains parallel with the rod.

Figure 2:
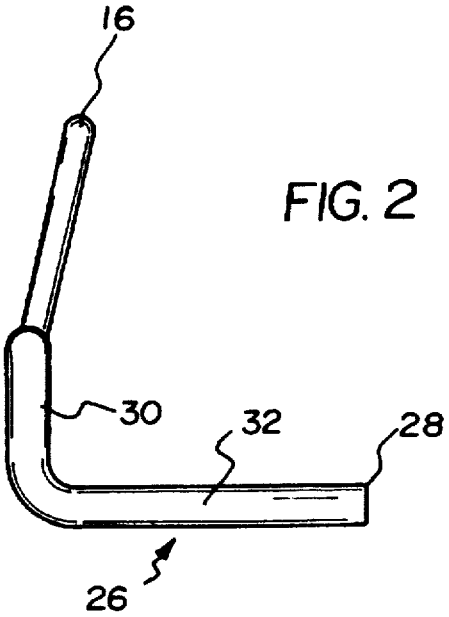
FIG. 2 is a side view of the present invention.

Finally, a mounting assembly 26 is provided including a pair of L-shaped members 28. Each L-shaped member has a short linear portion 30 integrally coupled at a first end thereof to a corresponding end of the rod and extending in a direction opposite that of the hangers. Note FIGS. 1 & 2. The L-shaped members of the mounting assembly further include a long linear portion 32 having a first end coupled to a second end of the corresponding short linear portion and extending in a direction perpendicular in relation with the hangers. It should be noted that the long linear portions of the L-shaped members each reside in a plane generally perpendicular with respect to the first plane.

In use, the helmets may be situated with the circular apertures thereof removably positioned on an associated one of the hangers. In a first mode of use, the handle may be utilized to carry the helmets. Further, the long linear portions of the mounting assembly may be situated within a pair of gaps of the chain-link fence such that the hangers are horizontally oriented for storing the helmets thereon in a second mode of use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A helmet carrying and hanger assembly comprising, in combination:

an elongated linear tubular rod having a pair of ends;

a plurality of short linear tubular hangers each having a first end coupled in perpendicular relationship along a length of the rod and a free second end, a length of each rod being equal to a width of the helmet, wherein the hangers are equally spaced and reside in a common first plane;

a T-shaped handle having a first extent in the first plane and with a length equal to that of the hangers and coupled to a central extent of the rod and a second extent integrally coupled at a center thereof in perpendicular relationship with the first extent of the handle for providing a grip for carrying purposes; and a mounting assembly including a pair of L-shaped members each having a short linear portion integrally coupled at a first end thereof to a corresponding end of the rod and extending in a direction opposite that of the hangers, the L-shaped members of the mounting assembly further including a long linear portion having a first end coupled to a second end of the corresponding short linear portion and extending in a direction perpendicular in relation with the hangers, wherein the L-shaped members each reside in a plane perpendicular with respect to the first plane;

whereby helmets may be situated with the circular apertures thereof removably positioned on an associated one of the hangers and the handle may be utilized to carry helmets in a first mode of operation and the long linear portions of the mounting assembly may be situated within a pair of gaps of a chain-link fence such that the hangers are horizontally oriented for storing helmets thereon in a second mode of operation.

* * * * *